US012084097B2

(12) United States Patent
Ebert et al.

(10) Patent No.: US 12,084,097 B2
(45) Date of Patent: Sep. 10, 2024

(54) WHEEL SET INTERMEDIATE FRAME FOR A RAIL VEHICLE

(71) Applicant: SIEMENS MOBILITY GMBH, Munich (DE)

(72) Inventors: Frank Ebert, Munich (DE); Manuel Kroiss, Ebersbach (DE); Hans Juergen Maerkl, Stadtbergen (DE)

(73) Assignee: Siemens Mobility GmbH, Munich (DE)

( * ) Notice: Subject to any disclaimer, the term of this patent is extended or adjusted under 35 U.S.C. 154(b) by 878 days.

(21) Appl. No.: 17/257,625

(22) PCT Filed: Jun. 19, 2019

(86) PCT No.: PCT/EP2019/066222

§ 371 (c)(1),
(2) Date: Jan. 4, 2021

(87) PCT Pub. No.: WO2020/007614

PCT Pub. Date: Jan. 9, 2020

(65) Prior Publication Data

US 2021/0284204 A1 Sep. 16, 2021

(30) Foreign Application Priority Data

Jul. 3, 2018 (DE) ..... 102018210880.3

(51) Int. Cl.
*B61F 1/06* (2006.01)
*B61F 1/12* (2006.01)
(Continued)

(52) U.S. Cl.
CPC ..... *B61F 1/06* (2013.01); *B61F 1/12* (2013.01); *B61F 1/14* (2013.01); *B61F 3/04* (2013.01);
(Continued)

(58) Field of Classification Search
CPC ..... B61F 15/04; B61F 15/10; B61F 15/18; B61F 15/20; B61F 5/00; B61F 5/52;
(Continued)

(56) References Cited

U.S. PATENT DOCUMENTS 173,919 A 2/1876 Dotterer
2,907,283 A * 10/1959 Markestein ..... B61F 5/148 105/182.1

(Continued)

FOREIGN PATENT DOCUMENTS

CH 703173 A2 * 11/2011 ..... B61F 3/16
CN 1100047 A * 3/1995 ..... B61F 5/38

(Continued)

OTHER PUBLICATIONS

Pastokov et al: "Vagony: Uchebnik dlya tekhnikumov zh.-d. transp. ", ed. V.V. Lukin, Moscow, "Transport", 1988, pp. 91-95—English translation.

(Continued)

*Primary Examiner* — Zachary L Kuhfuss
*Assistant Examiner* — James William Jones
(74) *Attorney, Agent, or Firm* — Laurence A. Greenberg; Werner H. Stemer; Ralph E. Locher

(57) ABSTRACT

A wheel set intermediate frame for a rail vehicle includes a plurality of mounting interfaces for chassis components at predetermined positions. Part of the wheel set intermediate frame for a rail vehicle is also at least one defined mounting interface for fixing to a subframe of a car body of a rail vehicle. A rail vehicle and a method for producing a wheel set intermediate frame for a rail vehicle are also provided.

9 Claims, 2 Drawing Sheets

(51) Int. Cl.

| | |
|---|---|
| ***B61F 1/14*** | (2006.01) |
| ***B61F 3/04*** | (2006.01) |
| ***B61F 3/06*** | (2006.01) |
| ***B61F 3/16*** | (2006.01) |
| ***B61F 15/04*** | (2006.01) |
| ***B61F 15/10*** | (2006.01) |
| ***B61F 15/18*** | (2006.01) |
| ***B61F 15/20*** | (2006.01) |
| *B61F 5/00* | (2006.01) |
| *B61F 5/04* | (2006.01) |
| *B61F 5/28* | (2006.01) |
| *B61F 5/40* | (2006.01) |
| *B61F 5/52* | (2006.01) |

(52) U.S. Cl.
CPC ..... *B61F 3/06* (2013.01); *B61F 3/16* (2013.01); *B61F 15/04* (2013.01); *B61F 15/10* (2013.01); *B61F 15/18* (2013.01); *B61F 15/20* (2013.01); *B61F 5/00* (2013.01); *B61F 5/04* (2013.01); *B61F 5/28* (2013.01); *B61F 5/40* (2013.01); *B61F 5/52* (2013.01)

(58) Field of Classification Search
CPC ..... B61F 5/04; B61F 5/28; B61F 5/40; B61F 3/16; B61F 1/12; B61F 1/14; B61F 3/04; B61F 3/06; B61F 1/07
USPC ..... 105/157.1, 172, 174, 199.5, 133, 136, 105/96.1, 34.1, 73–82; 104/172, 174
See application file for complete search history.

(56) References Cited

U.S. PATENT DOCUMENTS

| | | | | | |
|---|---|---|---|---|---|
| 3,011,458 | A * | 12/1961 | Wirth | B61F 3/06 | 105/157.1 |
| 3,602,149 | A * | 8/1971 | Lich | B60V 3/04 | 105/49 |
| 4,091,739 | A * | 5/1978 | Theurer | B61F 5/301 | 105/199.5 |
| 4,167,906 | A * | 9/1979 | Steinmann | B61F 5/44 | 105/135 |
| 4,202,276 | A * | 5/1980 | Browne | B61D 3/184 | 303/2 |
| 4,444,121 | A * | 4/1984 | Tilly | B61F 5/32 | 105/208 |
| 4,445,439 | A * | 5/1984 | Tilly | B61F 5/32 | 105/208 |
| 4,469,028 | A * | 9/1984 | Dean, II | B61F 5/40 | 267/221 |
| 4,561,360 | A * | 12/1985 | Mulcahy | B61F 5/308 | 105/218.1 |
| 4,583,464 | A * | 4/1986 | Harwood | B61F 5/325 | 105/157.1 |
| 4,628,824 | A * | 12/1986 | Goding | B61F 5/52 | 105/182.1 |
| 4,637,318 | A * | 1/1987 | Paton | B61F 5/24 | 105/182.1 |
| 4,651,650 | A * | 3/1987 | Tylisz | B61F 5/308 | 267/293 |
| 4,679,506 | A * | 7/1987 | Goding | B61F 3/06 | 105/166 |
| 4,697,526 | A * | 10/1987 | Vigliani | B61G 5/02 | 267/3 |
| 4,699,065 | A * | 10/1987 | Kibble | B61F 5/301 | 105/199.5 |
| 4,813,359 | A * | 3/1989 | Marulic | B61F 5/30 | 105/206.2 |
| 4,889,054 | A * | 12/1989 | List | B61F 5/24 | 105/167 |
| 4,938,152 | A * | 7/1990 | List | B61F 5/52 | 105/208 |
| 4,941,409 | A * | 7/1990 | Richter | B61F 3/16 | 105/157.1 |
| 5,000,097 | A * | 3/1991 | List | B61F 5/24 | 105/167 |
| 5,001,989 | A * | 3/1991 | Mulcahy | B61F 5/325 | 267/4 |
| 5,174,218 | A * | 12/1992 | List | B61F 5/42 | 105/167 |
| 5,524,552 | A * | 6/1996 | Weber | B61F 3/00 | 213/15 |
| 5,775,231 | A | 7/1998 | Kammerhofer et al. | | |
| 10,625,755 | B2 | 4/2020 | Thoni | | |
| 2008/0098925 | A1* | 5/2008 | Vithani | B61F 5/30 | 105/157.1 |
| 2010/0192800 | A1* | 8/2010 | Holzapfel | B61C 9/50 | 105/96 |
| 2014/0261061 | A1* | 9/2014 | Chu | B61F 3/04 | 105/96 |

FOREIGN PATENT DOCUMENTS

| | | | | | |
|---|---|---|---|---|---|
| CN | 101837792 | A | 9/2010 | | |
| CN | 105197047 | A | 12/2015 | | |
| CN | 105934383 | A | 9/2016 | | |
| DE | 19825858 | A1 | 12/1999 | | |
| DE | 202004014706 | U1 | 1/2005 | | |
| DE | 102005057120 | A1 | 5/2007 | | |
| DE | 102014200592 | A1 | 7/2015 | | |
| DE | 102014210995 | A1 | 12/2015 | | |
| DE | 102014117047 | A1 | 5/2016 | | |
| EP | 0410407 | A2 * | 1/1991 | | |
| EP | 0501204 | A1 * | 9/1992 | | |
| EP | 0775621 | A1 | 5/1997 | | |
| EP | 2423067 | A1 | 2/2012 | | |
| EP | 2540592 | A1 | 1/2013 | | |
| EP | 2557015 | A2 * | 2/2013 | B61F 5/30 | |
| EP | 2669136 | A1 * | 12/2013 | B61F 5/00 | |
| FR | 1333277 | A | 7/1963 | | |
| GB | 219176 | A | 7/1924 | | |
| GB | 1320542 | A | 6/1973 | | |
| KR | 101498450 | B1 | 3/2015 | | |
| RU | 2143356 | C1 | 12/1999 | | |
| RU | 2347701 | C1 | 2/2009 | | |
| RU | 2464189 | C2 | 10/2012 | | |
| WO | WO-9723375 | A2 * | 7/1997 | B60G 5/04 | |
| WO | WO-2012089060 | A1 * | 7/2012 | B61F 3/02 | |
| WO | WO-2013091319 | A1 * | 6/2013 | B61F 3/02 | |
| WO | WO-2014177417 | A1 * | 11/2014 | B61F 15/20 | |
| WO | WO-2017219554 | A1 * | 12/2017 | B61F 5/04 | |

OTHER PUBLICATIONS

Krainev A. F. et al; "Mekhanika Maschine"; Fundamentalnyj slowar; Moskau, Maschinostrojenije, 2000; pp. 162-163; 2000; [Mechanics of Machines, The Fundamental Dictionary, Mechanical Engineering, Moscow, 2000]13 English abstract.

* cited by examiner

WHEEL SET INTERMEDIATE FRAME FOR A RAIL VEHICLE

BACKGROUND OF THE INVENTION

Field of the Invention

The invention relates to a rail vehicle wheel set intermediate frame. In addition, the invention relates to a rail vehicle. Furthermore, the invention relates to a method for producing a rail vehicle wheel set intermediate frame.

If wheel sets without a bogie frame are mounted directly on a car body of a rail vehicle, then the necessary tolerances of the attachment points are very small, and the number of attachment points is very large. For example, attachment points are required for the longitudinal follower, the suspension, the drive suspension, the braking device and the damping unit.

In order to mount the individual chassis components on the car body, machining of the attachment points on the car body is normally required. For the machining operation, a correspondingly comprehensive machining station is needed. Considerable technical effort is necessary for this purpose.

For the aforementioned mounting variants, considerable effort is consequently necessary.

SUMMARY OF THE INVENTION

There is therefore the object of specifying a device and method with which an attachment of chassis components to a sub-frame of a rail vehicle with reduced effort is made possible.

This object is achieved by a rail vehicle wheel set intermediate frame, a rail vehicle and a method for producing a rail vehicle wheel set intermediate frame as described below.

The rail vehicle wheel set intermediate frame according to the invention has a plurality of mounting interfaces for chassis components at predetermined positions. A chassis can comprise all the components which are used to connect the chassis and the car body via the wheels to the rails or the interaction of the wheels with the rails. In the intended arrangement of the intermediate frame, the plurality of mounting interfaces is arranged on the underside of the intermediate frame, that is to say on the side of the intermediate frame that faces the ground. Advantageously, the plurality of mounting interfaces is formed directly on the space-saving intermediate frame, so that no machining stations of large dimensions are necessary. The rail vehicle wheel set intermediate frame according to the invention has at least one defined mounting interface for fixing to a sub-frame of a car body of a rail vehicle. The defined mounting interface is arranged on the sides or the upper side of the intermediate frame, that is to say the side of the intermediate frame that faces away from the ground. The arrangement of the wheel sets, that is to say the chassis components, is highly simplified by the introduction of the intermediate frame, since only the intermediate frames but not a multiplicity of individual interfaces have to be positioned relative to one another on the sub-frame of the car body. The positioning of the individual chassis components relative to the sub-frame and the car body can be carried out very easily by, for example, forming a common interface between the intermediate frame and the sub-frame of the car body or by aligning the intermediate frames.

The rail vehicle according to the invention has a rail vehicle wheel set intermediate frame on its car body. The rail vehicle according to the invention shares the advantages of the rail vehicle wheel set intermediate frame according to the invention.

In the method according to the invention for producing a rail vehicle wheel set intermediate frame, a plurality of mounting interfaces for chassis components is arranged at predetermined positions of the rail vehicle wheel set intermediate frame. Furthermore, at least one defined mounting interface for fixing to a sub-frame of a car body of a rail vehicle is formed on the rail vehicle wheel set intermediate frame. The method according to the invention for producing a rail vehicle wheel set intermediate frame shares the advantages of the rail vehicle wheel set intermediate frame according to the invention.

The dependent claims and the following description each include particularly advantageous refinements and developments of the invention. In particular, the claims of one claim category can also be developed in a way analogous to the dependent claims of another claim category and the description parts thereof. In addition, within the context of the invention, the various features of different exemplary embodiments and claims can also be combined to form new exemplary embodiments.

In a preferred refinement of the rail vehicle wheel set intermediate frame according to the invention, the mounting interfaces have a mounting interface for a wheel set guide. The wheel set guide is used to transmit the longitudinal forces between the wheel set and the wheel set intermediate frame and to guide the wheel set in the track. Advantageously, a wheel set can be positioned exactly in a simple manner without complicated machining operations on the car body of a rail vehicle being necessary.

In a variant of the rail vehicle wheel set intermediate frame according to the invention, the plurality of mounting interfaces has a mounting interface for a drive suspension. A drive suspension can comprise load-bearing elements for components for the traction of a vehicle, such as, for example, an electric motor, a gearbox and so on. Advantageously, the arrangement and mounting of the drive suspension can be carried out on a compact and easily machined intermediate frame.

In a refinement of the rail vehicle wheel set intermediate frame according to the invention, the plurality of mounting interfaces has a mounting interface for a braking device. The braking device must be positioned exactly relative to the wheels in order to develop a braking effect. Advantageously, the relative positioning of the braking device relative to the wheels or relative to the suspension of the wheels can be carried out with little effort on a compact intermediate frame.

In a specific variant of the rail vehicle wheel set intermediate frame according to the invention, the plurality of mounting interfaces has a mounting interface for a damping unit. Such a damping unit usually has a hydraulic or mechanical damping element, which is in contact with an axle suspension. Advantageously, because of the compact dimensions of the wheel set intermediate frame, the exact positioning of the suspension of the damping element on the rail vehicle can be carried out in a simplified manner.

In a specific variant of the rail vehicle wheel set intermediate frame according to the invention, the latter has any desired combination of the aforementioned interfaces.

The rail vehicle wheel set intermediate frame according to the invention can be dimensioned in such a way that the rail vehicle wheel set intermediate frame is substantially smaller than the car body. Advantageously, the rail vehicle wheel set intermediate frame can be machined more easily than a considerably more largely dimensioned car body. In particular, for example, individual holes for interfaces for chassis components can be exactly positioned more easily than in a more largely dimensioned car body since, for example, the tools and measuring devices used for this purpose can have smaller dimensions.

The invention will be explained in more detail below with reference to the appended figures and by using exemplary embodiments.

DETAILED DESCRIPTION OF THE INVENTION

Figure 1:
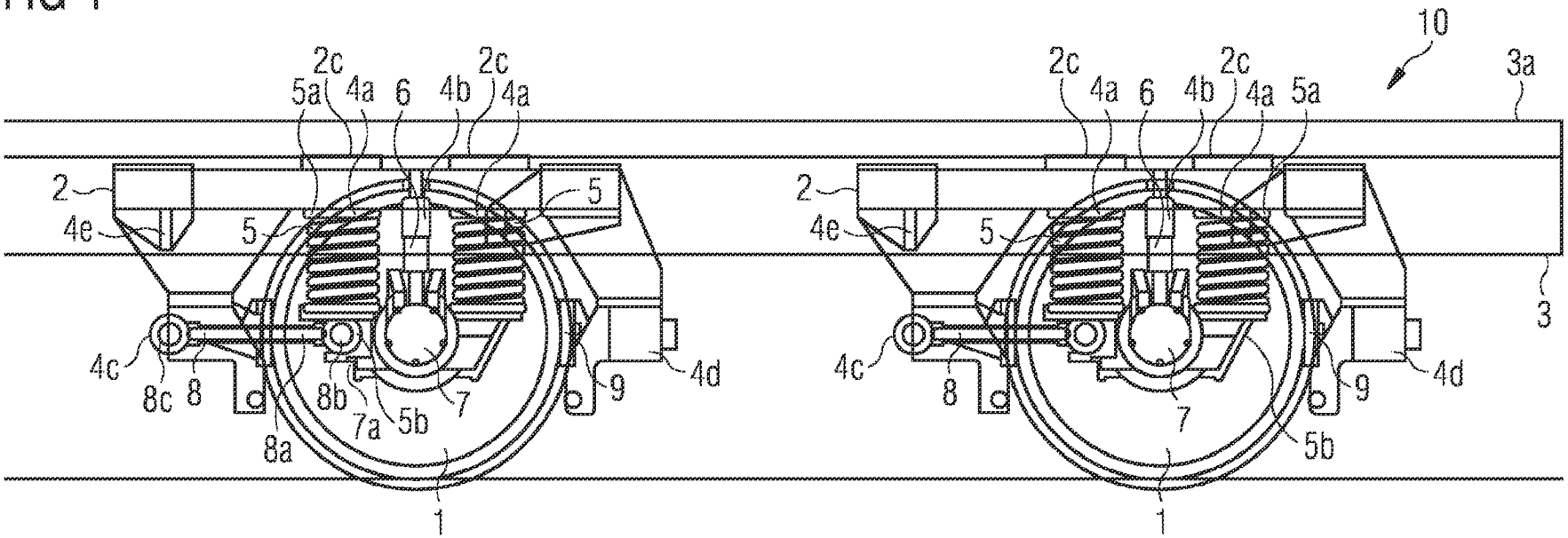
FIG. 1 shows a schematic side view of a rail vehicle having one or more wheel set intermediate frames according to an exemplary embodiment of the invention.

FIG. 1 shows a schematic side view of a lower region of a railway vehicle 10 having a rail vehicle wheel set intermediate frame 2, also designated as a wheel set intermediate frame or intermediate frame for short, according to an exemplary embodiment of the invention. The railway vehicle 10 has a car body with a sub-frame 3, which is used as a load-bearing structure both for a chassis and for structures. The sub-frame has so-called longitudinal members 3*a*, to which the wheel set intermediate frames 2 are fixed at interfaces 2*c*. Such a wheel set intermediate frame 2 has a multiplicity of further interfaces 4*a*, 4*b*, 4*c*, 4*d*, 4*e*, on which different chassis components 5, 6, 7, 8, 9 are mounted. The multiplicity of further interfaces 4*a*, 4*b*, 4*c*, 4*d*, 4*e*, include a mounting interface 4*a*, 4*b*, 4*c* for a wheel set guide that includes spring/suspension elements 5, a shock absorber 6 and a longitudinal follower 8. The wheel set guide is used to transmit the longitudinal forces between the wheel set and the wheel set intermediate frame 2 and to guide the wheel set in the track. Spring elements 5 are fixed by a first end 5*a* to suspension interfaces 4*a* of the wheel set intermediate frame 2. A second end 5*b* of the suspension elements 5 is connected to an axle bearing 7*a*. The suspension element 5 is supplemented by a shock absorber 6 which, for example, is arranged between the two suspension elements 5 of a wheel 1, viewed from the side. The shock absorber 6 damps an oscillatory behavior of the suspension elements 5 in order thus to maintain an uninterrupted contact of the wheels 1 with a rail. The shock absorbers 6 are each mounted by one end on a shock absorber interface 4*b* of the wheel set intermediate frame 2 and are connected by a second end to an axle bearing 7*a*. The wheel set, comprising axles 7 and wheels 1, is stabilized in the longitudinal direction by a so-called longitudinal follower 8. The longitudinal follower 8 has, for example, a rod 8*a*, of which one end 8*b* is connected to the axle bearing 7*a* of a wheel 1, and its second end 8*c* is connected to a longitudinal follower support 4*c*. The longitudinal follower support 4*c* is in turn fixed to the wheel set intermediate frame 2. Furthermore, a disk or block brake 9 is connected to the wheel set intermediate frame 2 via a brake interface 4*d*. Also indicated in FIG. 1 is a drive interface 4*e*, which is likewise mounted on the intermediate frame 2.

Figure 2:
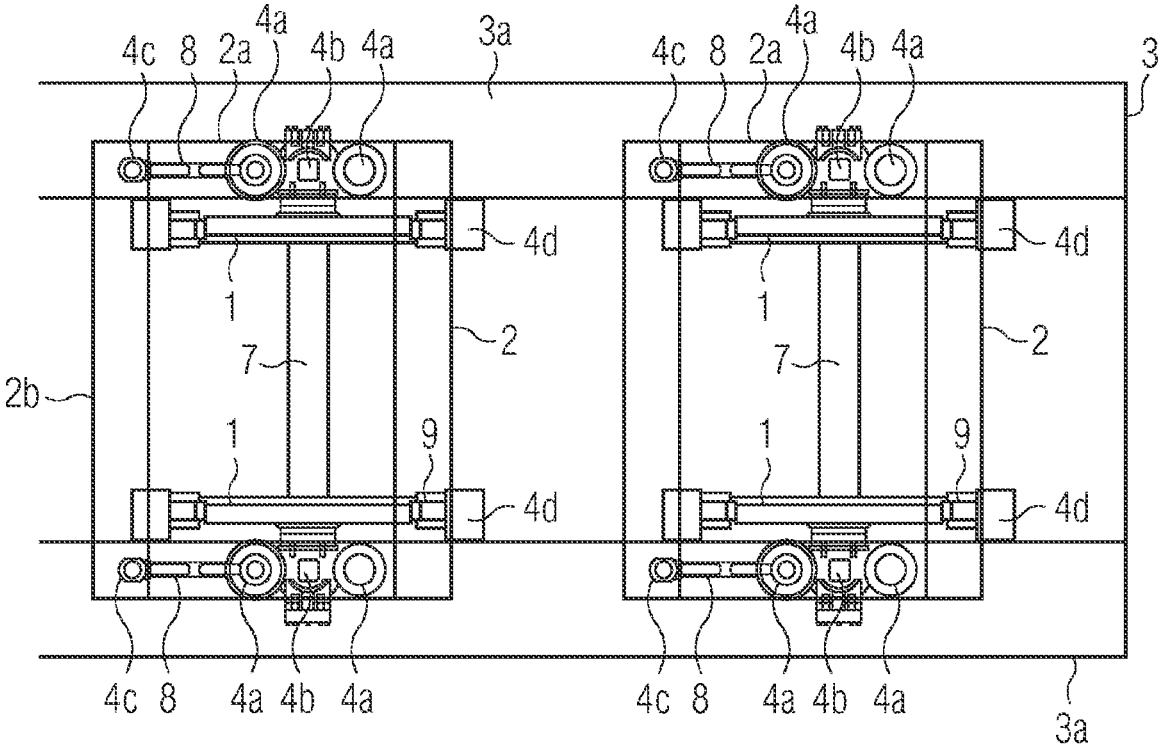
FIG. 2 shows a plan view of the rail vehicle shown in FIG. having one or more wheel set intermediate frames according to an exemplary embodiment of the invention.

FIG. 2 illustrates a plan view of the railway vehicle 10 shown in FIG. 1 having one or more wheel set intermediate frames 2 according to an exemplary embodiment of the invention. The wheel set intermediate frame 2 has longitudinal members 2*a* and cross-members 2*b*, which are connected via interfaces 2*c* to the longitudinal members 3*a* of the sub-frame 3 for fixing the wheel set intermediate frame 2 to the sub-frame 3. Arranged on the longitudinal members 2*a* of the wheel set intermediate frame 2 are interfaces 4*a* for the spring element 5 of the axle supports 7*a* (see FIG. 1). Furthermore, interfaces 4*b* for shock absorbers 6 are arranged between the (see FIG. 1) aforementioned interfaces 4*a* for the spring elements 5. Interfaces 4*c* for the longitudinal followers 8 are arranged in the transition region between the longitudinal members 2*a* and the cross-member 2*b* of the wheel set intermediate frame 2. Interfaces 4*d* for the disk or block brakes 9 are positioned on the cross-members 2*a* of the wheel set intermediate frame 2.

Figure 3:
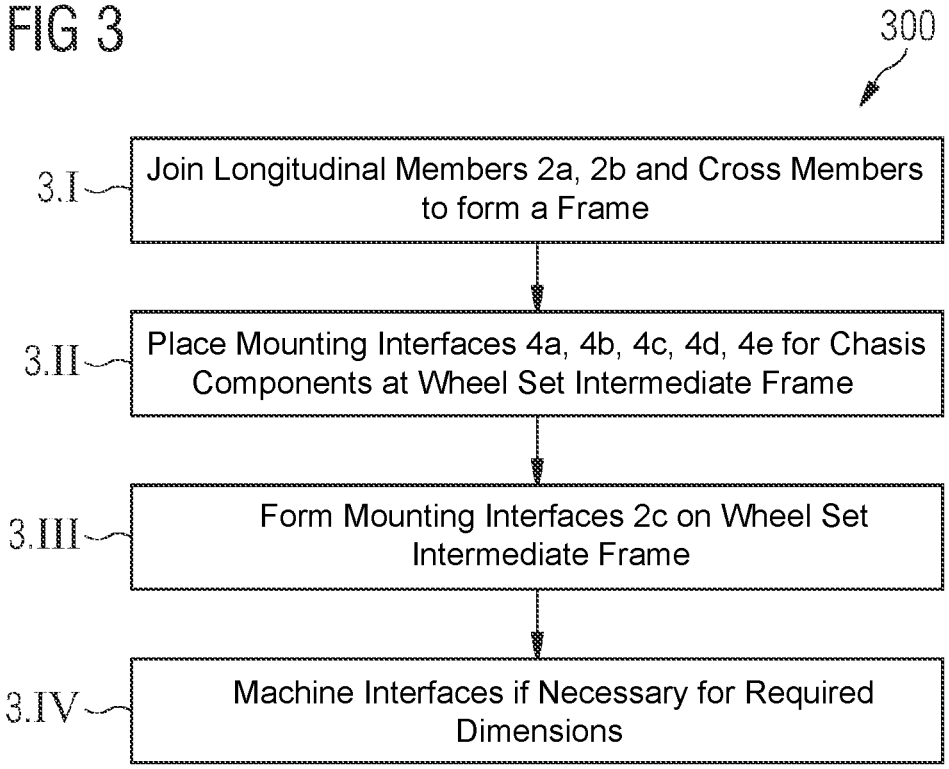
FIG. 3 shows a flow chart which illustrates a method for producing a rail vehicle wheel set intermediate frame according to an exemplary embodiment of the invention.

FIG. 3 shows a flowchart 300 which illustrates a possible method for producing a rail vehicle wheel set intermediate frame according to an exemplary embodiment of the invention. In step 3.I, first of all the longitudinal members 2*a* and cross-members 2*b* are joined together to form a frame. In step 3.II, a plurality of mounting interfaces 4*a*, 4*b*, 4*c*, 4*d*, 4*e* for chassis components is arranged at predefined positions of the rail vehicle wheel set intermediate frame 2. For example, mounting interfaces 4*a* for axle suspension elements 5 are arranged on the longitudinal members of the rail vehicle wheel set intermediate frame 2. Likewise, mounting interfaces 4*b* for dampers 6 are formed between the mounting interfaces 4*a* for axle suspension elements 5 on the longitudinal members 2*a* of the rail vehicle wheel set intermediate frame 2. In addition, interfaces 4*c* for fixing the longitudinal followers 8 are arranged at the corner points of the rail vehicle wheel set intermediate frame 2. Furthermore, interfaces 4*d* for the fixing of braking elements 9 are also formed on the cross-members 2*b* of the rail vehicle wheel set intermediate frame 2. Finally, interfaces 4*e* for the fixing of drive elements to the rail vehicle wheel set frame 2 can also be formed. In step 3.III, defined mounting interfaces 2*c* for fixing the wheel set intermediate frame 2 to a sub-frame 3 of a rail vehicle 10 are formed on the rail vehicle wheel set intermediate frame 2. In step 3.IV, finally, the previously arranged interfaces are machined if necessary to produce the required dimensions relative to one another.

In conclusion, it is pointed out once more that the above-described methods and devices are merely preferred exemplary embodiments of the invention and that the invention can be varied by those skilled in the art without leaving the scope of the invention, to the extent to which it is predefined by the claims. For completeness, it is also pointed out that the use of the indefinite article "a" or "one" does not exclude the relevant features also being present several times.

LIST OF DESIGNATIONS

1 Wheel
2 Wheel set intermediate frame
2*a* Longitudinal member of the wheel set intermediate frame
2*b* Cross-member of the wheel set intermediate frame
3 Sub-frame of the car body
3*a* Longitudinal support of the sub-frame
4*a* Suspension interface

4*b* Damper interface
4*c* Longitudinal follower support
4*d* Brake interface
4*e* Drive interface
5 Suspension
5*a* First end
5*b* Second end
6 Shock absorber
7 Axle
7*a* Axle bearing
8 Longitudinal follower
8*a* Rod
9 Block brake
10 Railway vehicle

The invention claimed is:

1. A rail vehicle wheel set intermediate frame for mounting a wheel set without a bogie frame on a sub-frame of a car body of a rail vehicle, the wheel set intermediate frame comprising:

longitudinal frame members each having a mounting interface for engaging against a respective longitudinal member of the sub-frame and fixedly mounting the intermediate frame to the sub-frame;

a plurality of mounting interfaces disposed at predetermined positions for chassis components;

said plurality of mounting interfaces including a mounting interface for a wheel set guide, the wheel set guide configured to transmit longitudinal forces between the wheel set and the wheel set intermediate frame and to guide the wheel set on a track; and said plurality of mounting interfaces including a mounting interface for a braking device, the braking device positioned exactly relative to wheels of the wheel set to develop a braking effect.

2. The rail vehicle wheel set intermediate frame according to claim 1, wherein said plurality of mounting interfaces includes a mounting interface for a drive suspension, the drive suspension including supporting elements for components for traction of the rail vehicle.

3. The rail vehicle wheel set intermediate frame according to claim 1, wherein said plurality of mounting interfaces includes a mounting interface for a damping unit, the damping unit having a hydraulic or mechanical damping element in contact with an axle suspension.

4. The rail vehicle wheel set intermediate frame according to claim 1, wherein the rail vehicle wheel set intermediate frame is smaller than the car body.

5. A rail vehicle, comprising a rail vehicle wheel set intermediate frame according to claim 1.

6. The rail vehicle wheel set intermediate frame according to claim 1, further comprising cross frame members connected between said longitudinal frame members.

7. The rail vehicle wheel set intermediate frame according to claim 1, wherein said plurality of mounting interfaces includes a suspension mounting interface for a drive suspension, the drive suspension is connected between said suspension mounting interface and an axle bearing and said drive suspension including supporting elements for components for traction of the rail vehicle.

8. The rail vehicle wheel set intermediate frame according to claim 1, wherein said plurality of mounting interfaces includes a suspension mounting interface for a drive suspension, said suspension mounting interface being on an underside of said longitudinal frame member opposite said mounting interface.

9. A rail vehicle wheel set intermediate frame for mounting a wheel set without a bogie frame on a sub-frame of a car body of a rail vehicle, the wheel set intermediate frame comprising:

longitudinal frame members having mounting interfaces for fixedly mounting the intermediate frame to the sub-frame;

a plurality of component mounting interfaces disposed at predetermined positions for chassis components;

said plurality of component mounting interfaces including a wheel set guide component mounting interface for a wheel set guide, the wheel set guide configured to transmit longitudinal forces between the wheel set and the wheel set intermediate frame and to guide the wheel set on a track; and said plurality of component mounting interfaces including a braking component mounting interface for a braking device, the braking device positioned exactly relative to wheels of the wheel set to develop a braking effect, said braking component mounting interface being arranged on an underside of said longitudinal frame members.

* * * * *